United States Patent [19]

Sisak

[11] 4,346,897

[45] Aug. 31, 1982

[54] BOARD GAME APPARATUS

[76] Inventor: Harry A. Sisak, 24 Hearthstone Dr., Reading, Pa. 19606

[21] Appl. No.: 186,437

[22] Filed: Sep. 12, 1980

[51] Int. Cl.[3] ..... A63F 3/00

[52] U.S. Cl. ..... 273/271; 273/146; 273/292

[58] Field of Search ..... 273/269, 270, 271, 273, 273/299, 146, 292

[56] References Cited

U.S. PATENT DOCUMENTS

| | | | |
|---|---|---|---|
| 1,061,999 | 5/1913 | Grondahl | 273/269 |
| 2,611,616 | 9/1952 | Kloss | 273/243 |
| 4,114,290 | 9/1978 | Cooper | 273/146 |

FOREIGN PATENT DOCUMENTS

| | | | |
|---|---|---|---|
| 860109 | 2/1961 | United Kingdom | 273/299 |
| 1364872 | 8/1974 | United Kingdom | 273/269 |

*Primary Examiner*—Anton O. Oechsle

*Attorney, Agent, or Firm*—Benasutti Associates, Ltd.

[57] ABSTRACT

An educational and recreational game board apparatus is presented to facilitate the teaching of arithmetic operations by combining elements of chance with the performance of these arithmetic operations. The apparatus includes a game board with numbered spaces on which are placed tokens, the placement determined by both chance and the performance of arithmetic operations as indicated by a chance generating device. The operations are performed on numbers presented by some selection device such as a deck of numbered cards.

13 Claims, 9 Drawing Figures

BOARD GAME APPARATUS

BACKGROUND OF THE INVENTION

This invention relates to a board game apparatus and more particularly to a new educational game for two or more players which employs elements of both chance and skill at the level of elementary arithmetic.

In the teaching of arithmetic to children, most traditional instructional methods suffer from the inability to motivate students sufficiently so as to overcome their short attention spans. These methods are usually characterized as being repetitious and inflexible. Some examples include the memorizing of addition and multiplication tables and the performance of numerous repetitive exercises and drills.

SUMMARY OF THE INVENTION

The purpose of this invention is to ameliorate these deficiencies in an educational and competitive setting by use of a board game apparatus. Since this game requires the accurate performance of arithmetic calculations in order to win, it acts as an incentive to the players to improve their arithmetic skills. While the preferred embodiment of the game involves the symbolism and nomenclature of heraldry and playing cards, the successful outcome of the game is governed by a combination of chance and skill at the performance of elementary arithmetic operations.

Briefly, each player of the game is assigned one side of a four sided board with numbered spaces on each side. The object of the game is for a player to be the first to place a token on every space on his side of the board. The placing of the tokens is governed by rolling special dice which may determine an arithmetic operation. This operation is to be carried out on the numerical values of a pair of cards drawn from two randomly sorted decks of cards. The player, after rolling the dice, may be required to correctly perform an indicated arithmetic operation on the numerical values of the two cards drawn, the numerical outcome of which determines the spaces on which the tokens are to be placed. There are, however, other possible outcomes in which the player will alternatively lose a turn, lose all tokens already placed and be required to start over, or in certain cases may be allowed to attempt winning or to risk losing the entire game with one roll of a special die.

A feature of the invention is that the tokens, once placed, are left fixed and not moved unless they are taken off the board completely.

The principal object of the invention is to provide an apparatus to teach arithmetic operations to children in a setting which does not tax their attention span.

Another object of the invention is to provide an educational game flexible enough to be easily modified to suit the mathematical abilities of the players.

A further object of the invention is to introduce children to probabilistic decision making by allowing them to make entertaining and risky decisions.

These and other objects of my invention will become apparent from the following description with reference to the accompanying drawings.

DETAILED DESCRIPTION

Figure 1:
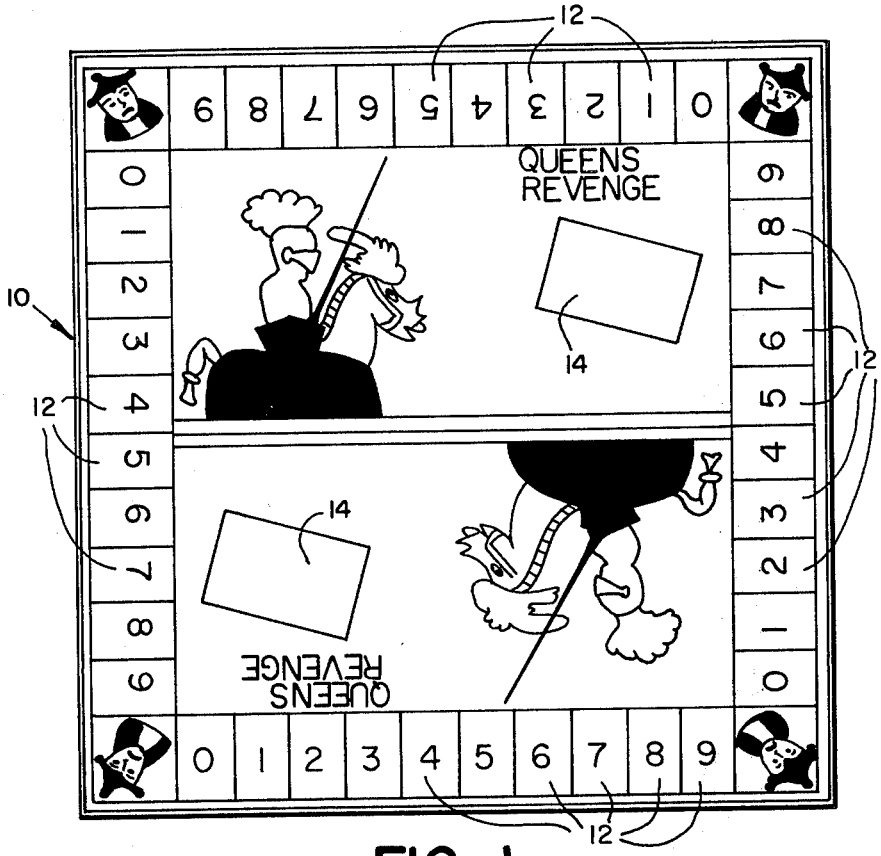
FIG. 1 is a plan view of one form of an arrangement of a board or playing field for the game, the lettering on the representative spaces being clearly indicated.
Figure 2:
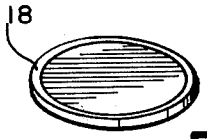
FIG. 2 is a perspective view of a token coin which is placed on the board as play proceeds.
Figure 3:
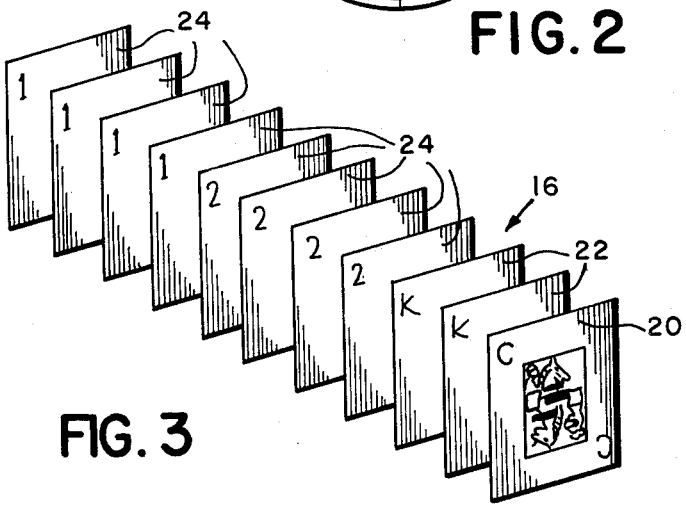
FIG. 3 is representative of a deck of cards to be provided with the game.
Figure 4:
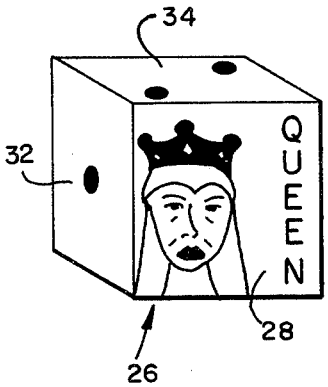
FIG. 4 is a perspective view of a first die showing some of the markings.
Figure 4A:
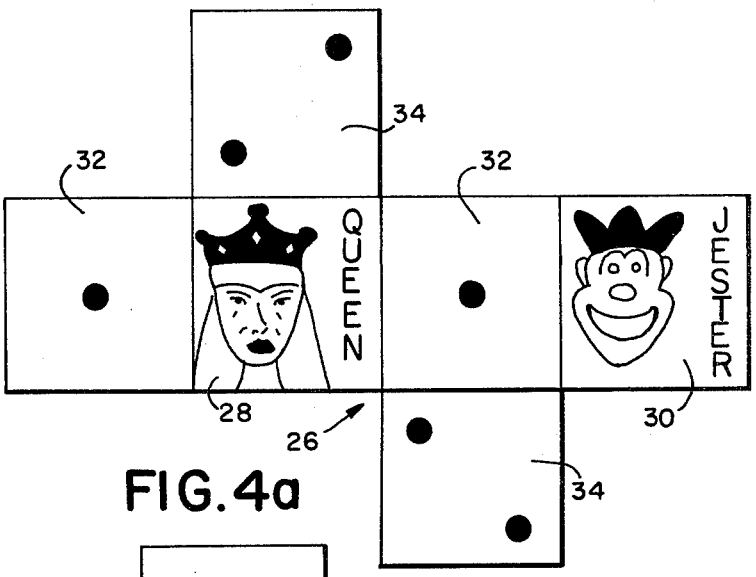
FIG. 4*a* is a representation of the first die with all faces showing, indicating various symbols controlling the play of the game.
Figure 5:
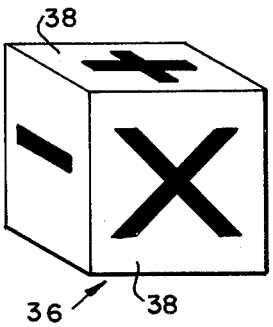
FIG. 5 is a perspective view of a second die containing mathematical operation symbols.
Figure 5A:
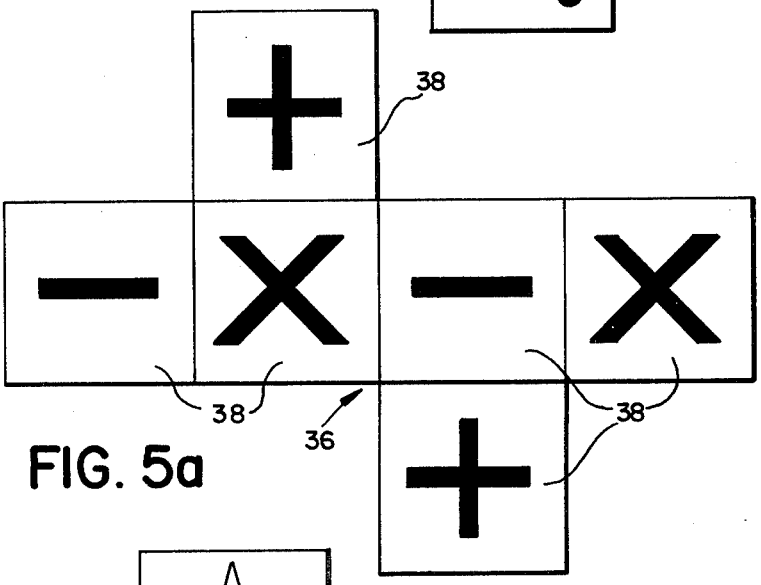
FIG. 5*a* is a representation of the second die with all faces showing, indicating various mathematical operation symbols.
Figure 6:
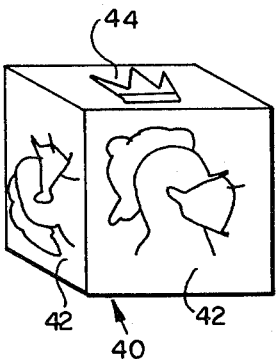
FIG. 6 is a perspective view of a third die containing figures of a Knight's Head and a Crown.
Figure 6A:
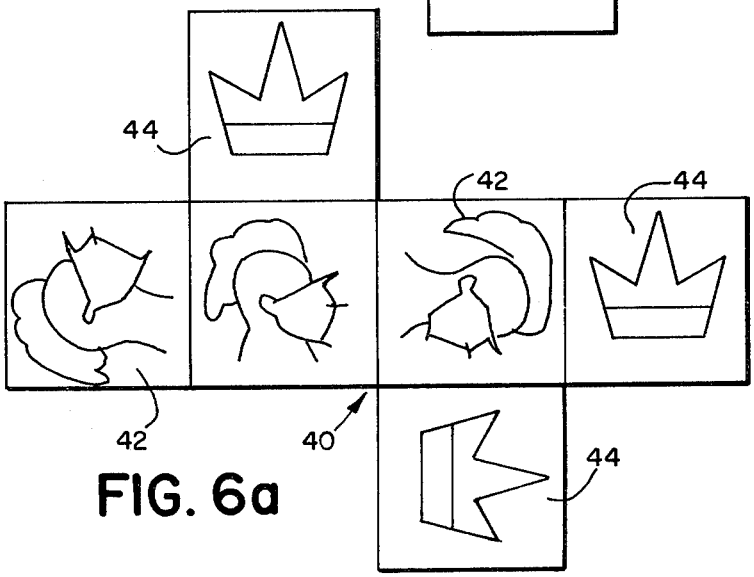
FIG. 6*a* is a representation of the third die with all faces showing, indicating three figures of the Knight's Head and three figures of the Crown.

As seen in FIG. 1, the preferred embodiment of the invention is a playing board 10 having four sides, and along each side, ten rectangles 12 numbered from zero to nine. In the center field of the board are two spaces 14 for placing the shuffled card decks 16. In FIG. 2, there is shown a representative coin token 18 for placing on the numbered rectangles on the board. FIG. 3 depicts a portion of one of two identical decks of cards 16 used in playing the preferred embodiment of the game of the present invention. Each deck 16 includes one card 20 bearing the figure of a Queen's Champion; a set 22 of four cards, each bearing the figure of a King; and four cards 24 for each numerical value from zero to ten. FIGS. 4 and 4*a* show a first die 26 containing a figure of a Queen 28 on one face; a figure of a Court Jester 30 on another face and having two additional faces 32, each containing one dot, and two faces 34, each containing two dots. FIGS. 5 and 5*a* show a second die 36 containing one arithmetic operation symbol on each face 38. FIGS. 6 and 6*a* show a third die 40 which has three faces marked with the figure of a knight 42 and three faces marked with the figure of a crown 44.

For each player the object of the game, "Queen's Revenge", embodied in the present invention is to become the "Queen's Champion" by being the first to place a token 18, called a Royal Coin, on every numbered rectangle 12 on that player's side of board 10. A player may also become the "Queen's Champion" by defeating the existing Queen's Champion in "combat" as described below. Play begins by having the players cut cards from either of the two decks 16 provided. The high card player goes first and play moves clockwise. In subsequent games the previous game's winner, "Queen's Champion", plays first.

The first die 26 and the second die 36 are tossed by each of the players at their turn. The first die 26 determines the play in the following manner: If the Queen 28 is rolled, that player must remove all Royal Coins 18 already placed on his numbered spaces 12 and will have to start over. This is known as the "Queen's Revenge" for having her "privacy disturbed". If the Court Jester 30 is rolled, the player loses his turn. If a single dot 32 is rolled an arithmetic operation is to be performed and the player will have an opportunity to place one Royal Coin 18 on a game board numbered space 12. If two dots 34 are rolled an arithmetic operation is to be performed and the player will have an opportunity to place two Royal Coins 18, one on each of two numbered spaces 12. The second die 36 determines which arithmetic operation is to be performed: addition, subtraction or multiplication, in the preferred embodiment.

If the performance of an arithmetic operation is indicated, a card is drawn from each of the two decks of cards 16 located in the spaces 12 provided on the board 10. The number on the first card 24 drawn is added to, subtracted from, or multiplied by the number on the second card drawn. A correct answer earns a player the opportunity to place a Royal Coin 18. However, the Royal Coin 18 must be placed on a space 12 with a number appearing in the result of the operation performed, e.g. if one dot appears on the first die 26, the second die 36 indicates that multiplication is to be performed and the two cards drawn were a three and a nine, then the correct result would be "27" and a Royal Coin could be placed on a space numbered either two or seven. Should the answer numbered spaces 12 already have Royal Coins 18 on them, then no Royal Coin 18 may be placed and the next player takes a turn. If two dots 34 were rolled on the first die 26, two Royal Coins 18 must be placed on answer numbered spaces 12. If only one answer numbered space 12 is open, one Royal Coin 18 is placed on it, and the second Royal Coin 18 may be placed on any other open numbered space 12. If no answer numbered space 12 is open, then only one Royal Coin 18 may be placed on any open numbered space 12.

If a player draws a King 22 from either deck, it may be saved for future use. No Royal Coins 18 are placed and the turn passes to the next player. If the player holding a King 22 subsequently rolls a Queen 28, the player may choose to play the King to "overrule" the Queen. If this choice is made, the player loses no Royal Coins 18 already placed. However, no Royal Coins 18 are earned on this turn, and the play passes to the next player. If the Queen's Champion card 20 is drawn, the player has the option of meeting the Queen's Champion in "mortal combat", or declining such "combat" and simply losing a turn. If combat is chosen, a third die 40 as shown in FIG. 6 is tossed. If a Crown 44 is rolled, the player wins the game and becomes the new Queen's Champion. But, if a Knight's Head 42 is rolled, the player loses everything and is out of the game.

If a player performs an arithmetic operation incorrectly, the error must be pointed out by another player or play continues as if it were correct. An incorrect answer only costs that player a turn. In the preferred form of play, there is no penalty for an incorrect challenge. Players must answer problems at the level of their ability. For example, players having experience with negative numbers, must give appropriate negative number answers in subtraction problems. Players inexperienced with negative numbers, are allowed to subtract the smaller from the larger number appearing on the cards. Negative answer numbers are treated as positive for Royal Coin placement.

The game board apparatus of the present invention is very versatile in that the form of play can be modified to suit different levels of skill of the players, and different variations of the game. For example, players may employ only one arithmetic operation for the entire game, rather than generating an operation by using the second die as previously described. In addition, instead of generating both numbers from card decks, players may use only one deck and select in advance a fixed number to be used in operating with a numbered card drawn from the deck. Also, cards having larger numerical and/or fractional values can be included in the decks. Furthermore, division or other operations can be included on the second die. In addition, a deck of division problems can be used. Also, a player who incorrectly challenges the answer of another player can be penalized. In addition, players who correctly challenge the incorrect answer of another player can be rewarded.

It is obvious that many additional changes and modifications can be made in the above-described details without departing from the nature and spirit of the invention. It is understood that the invention is not to be limited to said details except as set forth in the appended claims.

I claim:

1. A game board apparatus for combining chance play and the performance of mathematical operations comprising:

a. a game board each side of which contains spaces numbered from zero to nine;

b. a set of token coins to be placed on said numbered spaces on the board;

c. three dice marked as follows:

i. a first die with a figure of a Queen on one face, a figure of a Court Jester on another face, two faces containing one dot, and two faces containing two dots;

ii. a second die having faces marked with mathematical operation symbols;

iii. a third die having three faces marked with the figure of a Knight and three faces marked with the figure of a Crown;

d. two decks of cards, each deck consisting of one card containing a figure of a Queen's Champion, four Kings, and four cards for each numerical value from zero to ten.

2. A game board apparatus for combining chance play and the performance of mathematical operations comprising:

a. a game board each side of which contains a plurality of numbered spaces;

b. a set of markers to be placed on said numbered spaces on the board;

c. two dice marked as follows:

i. a first die with a first die figure on one face, a second die figure on another face, two faces containing one dot, and two faces containing two dots;

ii. a second die having three faces marked with a third die figure and three faces marked with a fourth die figure; and d. two decks of cards, each deck comprising one card containing a first card figure, four cards containing a second card figure, and four cards containing each of a plurality of numerical values.

3. A game board apparatus for combining chance play and the performance of mathematical operations comprising:

a. a game board each side of which contains a plurality of numbered spaces;

b. a set of markers to be placed on said numbered spaces on the board;

c. at least two dice marked as follows:

i. a first die with a first figure on one face, and a second figure on another face;

ii. a second die having three faces marked with a third figure and three faces marked with a fourth figure; and d. at least one deck of cards including at least two cards containing different figures thereon, and the remainder of which include numerical values thereon.

4. The game board apparatus of claim 3 further comprising a third die having faces marked with mathematical operation symbols.

5. The game board apparatus of claim 3 wherein said first die also has two faces containing one dot, and two faces containing two dots.

6. The game board apparatus of claim 3 including two decks of cards comprised of similar types of cards.

7. The game board apparatus of claim 3 wherein said first, second, third and fourth figures are pictoral markings.

8. The game board apparatus of claim 7 wherein said pictoral markings correspond to elements of heraldry.

9. The game board apparatus of claim 3 wherein said markers are tokens.

10. The game board apparatus of claim 3 wherein the game board includes ten numbered spaces on each side.

11. The game board apparatus of claim 3 wherein said deck of cards consists of cards having two different figures thereon and cards having numerical values thereon.

12. A game board apparatus for combining chance play and the performance of mathematical operations comprising:

a. a game board each side of which contains a plurality of numbered spaces;

b. a set of markers to be placed on said numbered spaces on the board;

c. a plurality of dice including:

i. means for determining placement of the markers on the numbered spaces;

ii. means for determining removal of the markers from the numbered spaces; and iii. means for immediately and finally determining the outcome of a game being played on said board game apparatus with respect to a selected player; and d. at least one deck of cards including at least two cards containing different figures thereon, and the remainder of which include numerical values thereon.

13. A game board apparatus for combining chance play and the performance of mathematical operations comprising:

a. a game board each side of which contains a plurality of numbered spaces;

b. a set of markers to be placed on said numbered spaces on the board;

c. two dice marked as follows:

i. a first die with a figure of a Queen on one face, a figure of a Court Jester on another face, two faces containing one dot, and two faces containing two dots;

ii. a second die having three faces marked with the figure of a Knight and three faces marked with the figure of a Crown; and d. a deck of cards comprising one card containing a figure of a Queen's Champion, four Kings, and four cards for each of a plurality of numerical values.

* * * * *